US007197861B2

(12) United States Patent
Higer et al.

(10) Patent No.: US 7,197,861 B2
(45) Date of Patent: Apr. 3, 2007

(54) VACUUM PACKAGING APPLIANCES

(75) Inventors: Landen Higer, Alameda, CA (US); Hongyu Wu, San Jose, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/903,860

(22) Filed: Jul. 29, 2004

(65) Prior Publication Data

US 2005/0028488 A1 Feb. 10, 2005

Related U.S. Application Data

(60) Provisional application No. 60/492,035, filed on Jul. 31, 2003.

(51) Int. Cl.
*B65B 31/02* (2006.01)

(52) U.S. Cl. ..... 53/512; 53/510; 53/405; 53/434

(58) Field of Classification Search ..... 53/79, 53/87, 88, 427, 432, 434, 477, 510, 512, 53/374.9, 375.6, 403; 99/472; 141/65; 426/404

See application file for complete search history.

(56) References Cited

U.S. PATENT DOCUMENTS

| | | | |
|---|---|---|---|
| 1,143,579 | A | 6/1915 | Denhard |
| 2,079,069 | A | 5/1937 | Johnson |
| 2,319,011 | A | 5/1943 | Meredith |
| 2,354,423 | A | 7/1944 | Rosenberger |
| 2,421,149 | A | 5/1947 | Hard et al. |
| 2,568,226 | A | 9/1951 | Drake |
| 2,617,304 | A | 11/1952 | Conover |
| 2,749,686 | A | 6/1956 | Lorenz et al. |
| 2,778,171 | A | 1/1957 | Taunton |
| 2,899,786 | A | 8/1959 | Harker |
| 3,038,283 | A | 6/1962 | Unger |
| 3,148,269 | A | 9/1964 | Van Hartesveldt et al. |
| 3,464,256 | A | 9/1969 | Lloyd |
| 3,516,223 | A | 6/1970 | Andersen et al. |
| 3,688,463 | A | 9/1972 | Titchenal |
| 3,699,742 | A | 10/1972 | Giraudi |
| 3,928,938 | A | 12/1975 | Burrell |
| 3,962,847 | A | 6/1976 | Trudel |
| 3,965,646 | A | 6/1976 | Hawkins |
| 4,006,329 | A | 2/1977 | Hellman et al. |

(Continued)

FOREIGN PATENT DOCUMENTS

| | | | |
|---|---|---|---|
| EP | 0723915 | A1 | 7/1996 |

(Continued)

*Primary Examiner*—Hemant M. Desai
(74) *Attorney, Agent, or Firm*—Lawrence J. Shurupoff

(57) ABSTRACT

Vacuum packaging appliances and methods of vacuum packaging objects are disclosed herein. In one embodiment, an appliance includes a base, a lid movably coupled to the base, a vacuum chamber portion on the base and/or the lid for receiving an open end of a bag, and a vacuum pump operably coupled to the vacuum chamber portion for removing gas from the vacuum chamber portion. The lid includes a distal end, a proximal end opposite the distal end, and a major dimension between the distal and proximal ends. The base can also include a distal end, a proximal end opposite the distal end, and a major dimension between the distal and proximal ends.

2 Claims, 9 Drawing Sheets

U.S. PATENT DOCUMENTS

| | | | | | |
|---|---|---|---|---|---|
| 4,008,601 | A | | 2/1977 | Woods | |
| 4,105,491 | A | | 8/1978 | Haase et al. | |
| 4,164,111 | A | | 8/1979 | Di Bernardo | |
| 4,208,902 | A | | 6/1980 | Kim et al. | |
| 4,330,975 | A | | 5/1982 | Kakiuchi | |
| 4,372,096 | A | | 2/1983 | Baum | |
| 4,541,224 | A | | 9/1985 | Mugnai | |
| 4,545,177 | A | | 10/1985 | Day | |
| 4,549,387 | A | | 10/1985 | Marshall et al. | |
| 4,561,925 | A | | 12/1985 | Skerjanec et al. | |
| 4,578,928 | A | | 4/1986 | Andre et al. | |
| 4,581,764 | A | | 4/1986 | Plock et al. | |
| 4,631,512 | A | | 12/1986 | Hishiki et al. | |
| 4,641,482 | A | | 2/1987 | Metz | |
| 4,928,829 | A | * | 5/1990 | Di Bernardo | 206/524.8 |
| 4,941,310 | A | | 7/1990 | Kristen | |
| 5,048,269 | A | * | 9/1991 | Deni | 53/512 |
| 5,352,323 | A | * | 10/1994 | Chi | 156/583.9 |
| 5,461,901 | A | | 10/1995 | Ottestad | |
| 5,608,167 | A | | 3/1997 | Hale et al. | |
| D389,847 | S | * | 1/1998 | Huang | D15/146 |
| 5,712,553 | A | | 1/1998 | Hallberg | |
| 5,765,608 | A | | 6/1998 | Kristen | |
| 5,784,862 | A | | 7/1998 | Germano | |
| 5,825,974 | A | | 10/1998 | Hutton | |
| 5,893,822 | A | * | 4/1999 | Deni et al. | 53/512 |
| 6,058,998 | A | | 5/2000 | Kristen | |
| 6,124,558 | A | | 9/2000 | Baumeister et al. | |
| 6,256,968 | B1 | * | 7/2001 | Kristen | 53/512 |
| 6,328,897 | B1 | | 12/2001 | Leung | |
| 6,467,242 | B1 | * | 10/2002 | Huang | 53/512 |
| 6,520,071 | B1 | | 2/2003 | Lanza | |
| 6,543,491 | B1 | * | 4/2003 | Chung | 141/65 |
| 6,694,710 | B2 | * | 2/2004 | Wang | 53/512 |
| 6,742,683 | B1 | * | 6/2004 | Phan | 223/84 |
| 2004/0065051 | A1 | * | 4/2004 | Patterson et al. | 53/432 |

FOREIGN PATENT DOCUMENTS

| | | | | |
|---|---|---|---|---|
| EP | 1053945 | A1 | | 11/2000 |
| JP | 05-10211 | | | 2/1993 |
| JP | 2000-43818 | | | 2/2000 |
| KR | 20-0231617 | | * | 5/2001 |
| WO | WO00/71422 | | | 11/2000 |

* cited by examiner

VACUUM PACKAGING APPLIANCES

CROSS-REFERENCE TO RELATED APPLICATION

This application claims the benefit of Higer et al.'s U.S. Provisional Patent Application No. 60/492,035, filed Jul. 31, 2003, which is hereby incorporated by reference in its entirety.

TECHNICAL FIELD

The present invention generally relates to vacuum packaging appliances and methods of vacuum packaging objects. In particular, the present invention teaches appliances with small footprints, alternative orientation configurations, and alternative hinging systems and methods for using the same.

BACKGROUND

Vacuum packaging involves removing air or other gases from a storage container and then sealing the container to prevent the contents from being exposed to ambient air. Vacuum packaging is particularly useful in protecting food and other perishables against oxidation. Oxygen is a main cause of food spoilage and contributes to the growth of bacteria, mold, and yeast. Accordingly, vacuum-packaged food often lasts three to five times longer than food stored in ordinary containers. Moreover, vacuum packaging is useful for storing clothes, photographs, silver, and other items to prevent discoloration, corrosion, rust, and tarnishing. Vacuum packaging also produces tight, strong, and compact packages, reducing the bulk of articles and allowing for more space to store other supplies.

FIGS. 1A–1B are schematic isometric views of a conventional appliance 1 for vacuum packaging an object 98 (shown in broken lines) in accordance with the prior art. The vacuum packaging appliance 1 includes a base 10, a lid 50 pivotably coupled to the base 10, a lower trough 22 in the base 10, an upper trough (not shown) in the lid 50, and a vacuum pump (not shown) operably coupled to the upper trough. The lid 50 pivots between an open position (shown in FIG. 1B), in which a portion of a bag 90 can be placed between the lid 50 and the base 10, and a closed position (shown in FIG. 1A), in which the bag 90 can be evacuated and thermally sealed.

In the closed position, the upper trough and the lower trough 22 are aligned and form a vacuum chamber to remove gas from the interior of the bag 90. The base 10 includes a seal 24 surrounding the vacuum chamber to seal the chamber from ambient air while gas is removed from the interior of the bag 90. The vacuum packaging appliance 1 further includes a heating element 30 to thermally seal the bag 90 after the gas has been evacuated. A vacuum packaging appliance of this type is disclosed in U.S. Pat. No. 4,941,310, which is hereby incorporated by reference in its entirety.

Conventional vacuum packaging bags include two panels attached together with an open end. Typically, the panels each include two or more layers. The inner layer can be a heat sealable material, and the outer layer can be a gas impermeable material to provide a barrier against the influx of air. The plasticity temperature of the inner layer is lower than the outer layer. As such, the bag can be heated to thermally bond the inner layer of each panel together to seal the bag without melting or puncturing the outer layer.

A conventional vacuum packaging process includes depositing the object 98 in the bag 90 and positioning an open end 92 of the bag 90 in the lower trough 22 of the vacuum packaging appliance 1. Next, the lid 50 pivots downward to form the vacuum chamber with the open end 92 of the bag 90 disposed within the vacuum chamber. The vacuum pump then removes gas from the vacuum chamber and the interior of the bag 90, which is in fluid communication with the vacuum chamber. After gas has been removed from the interior of the bag 90, the heating element 30 heats a strip of the bag 90 proximate to the open end 92 to bond the inner layer of each panel together and thermally seal the bag 90.

In FIG. 1B, the appliance 1 is shown resting on a counter 60. As is self-evident from FIG. 1B, the orientation of the appliance 1 necessarily limits the usable surface area of the counter 60 to the depth of the counter 60. As will be appreciated, the typical commercial or residential kitchen counter has greater length than depth. When the length of the bag 90 plus the depth of the appliance 1 exceeds the depth of the counter 60, the bag 90 will necessarily hang over the edge of the counter 60. Particularly with heavier or unwieldy items intended for storage in the bag 90, this arrangement can make operation of the appliance 1 difficult.

It will also be appreciated that conventional vacuum packaging appliances tend to have relatively large footprints and require significant space on a countertop or other surface. For example, the footprint of the appliance 1 illustrated in FIGS. 1A–1B is the surface area of the bottom of the base 10.

Accordingly, there is a need for vacuum packaging appliances with smaller footprints that operate at an orientation better suited to utilize available counter surface area.

BRIEF DESCRIPTION OF THE DRAWINGS

PRIOR ART

DETAILED DESCRIPTION

A. Overview

Figure 1A:
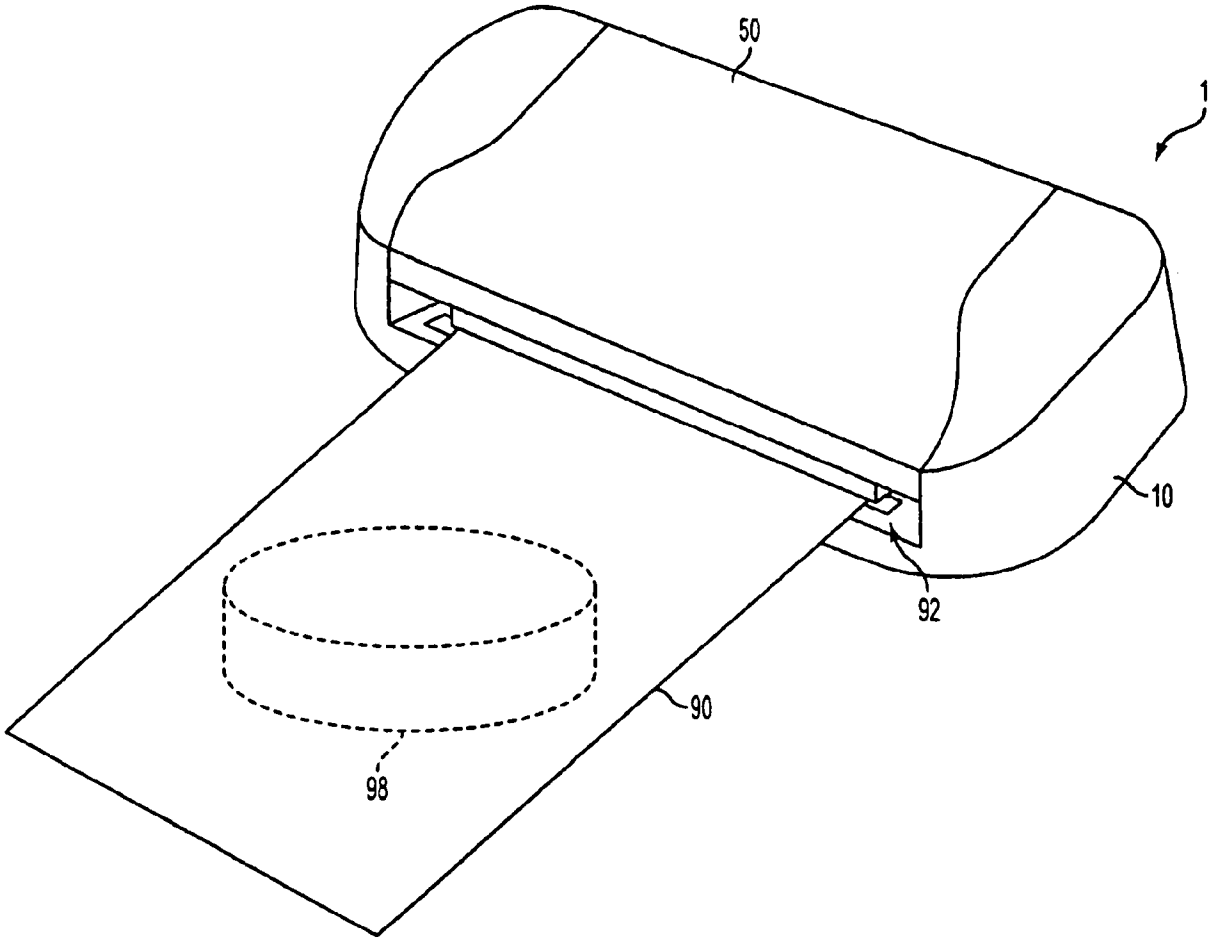
FIG. 1A PRIOR ART
FIGS. 1A–1B are schematic isometric views of a conventional appliance for vacuum packaging objects in accordance with the prior art.
Figure 1B:
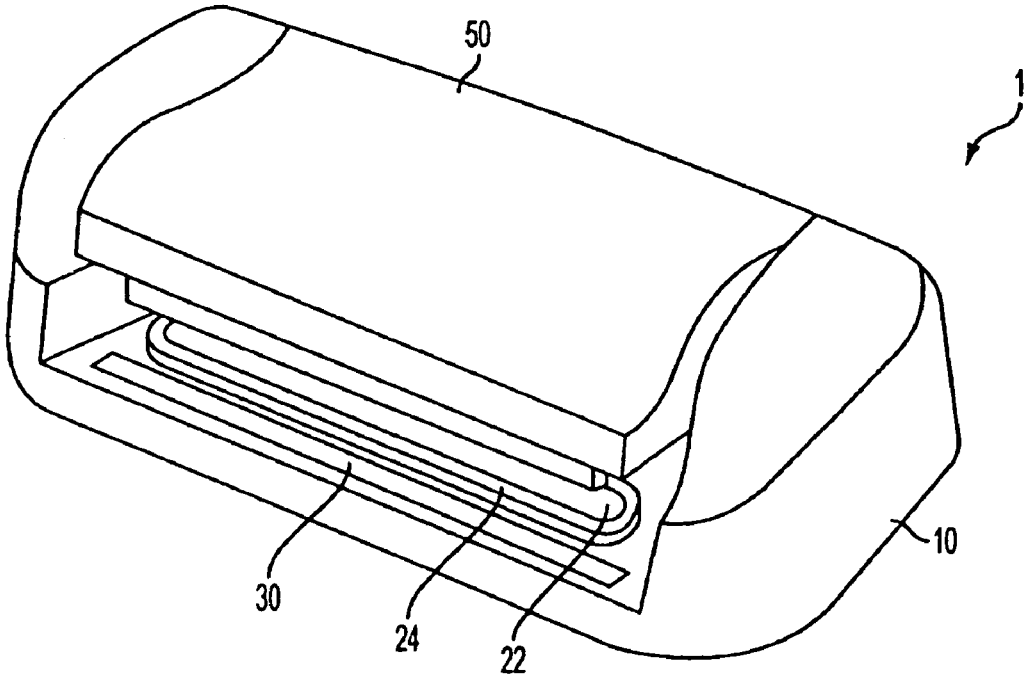
FIG. 1B PRIOR ART

The present invention is directed to vacuum packaging appliances and methods of vacuum packaging objects. One aspect of the invention is directed to vacuum packaging appliances for use with a bag. In one embodiment, an appliance includes a base, a lid movably coupled to the base, a vacuum chamber portion on the base and/or the lid for receiving an open end of the bag, and a vacuum pump operably coupled to the vacuum chamber portion for removing gas from the vacuum chamber portion. The lid includes a distal end, a proximal end opposite the distal end, and a major dimension between the distal end and the proximal end. The base can also include a distal end, a proximal end opposite the distal end, and a major dimension between the distal end and the proximal end.

In another embodiment, a vacuum packaging appliance includes a base and a lid movably coupled to the base. The lid is pivotable about an axis between an open position and a closed position. When the lid is in the closed position, the lid and base are configured to receive an open end of the bag between the lid and base with a body of the bag projecting from the appliance in a direction generally parallel to the axis. The base can have a length extending in a direction generally perpendicular to the axis. The lid may also have a length extending in a direction generally perpendicular to the axis.

In yet another embodiment, a vacuum packaging appliance includes a base, a lid movably coupled to the base, a vacuum chamber portion on the base and/or the lid, and a vacuum pump operably coupled to the vacuum chamber portion for removing gas from the vacuum chamber portion. The lid is pivotable about an axis between an open position and a closed position. The base has a first dimension and a second dimension less than the first dimension. The second dimension of the base extends in a direction generally parallel to the axis.

Another aspect of the invention is directed toward methods for removing at least a portion of a gas from a bag with a vacuum packaging appliance. In one embodiment, a method includes placing an open end of the bag on a base of the vacuum packaging appliance, pivoting a lid of the vacuum packaging appliance about an axis from an open position to a closed position, and at least substantially evacuating an interior region of the bag with the open end of the bag positioned between the lid and the base and a body of the bag projecting from the appliance in a direction generally parallel to the axis.

The following disclosure describes several embodiments of vacuum packaging appliances and methods of vacuum packaging objects. Several details describing structures and processes that are well known and often associated with vacuum packaging appliances are not set forth in the following description for purposes of brevity. Moreover, although the following disclosure sets forth several embodiments of different aspects of the invention, several other embodiments of the invention can have different configurations or different components than those described in this section. As such, it should be understood that the invention may have other embodiments with additional elements or without several of the elements described below with reference to FIGS. 2A–5B.

B. Embodiments of Vacuum Packaging Appliances

Figure 2A:
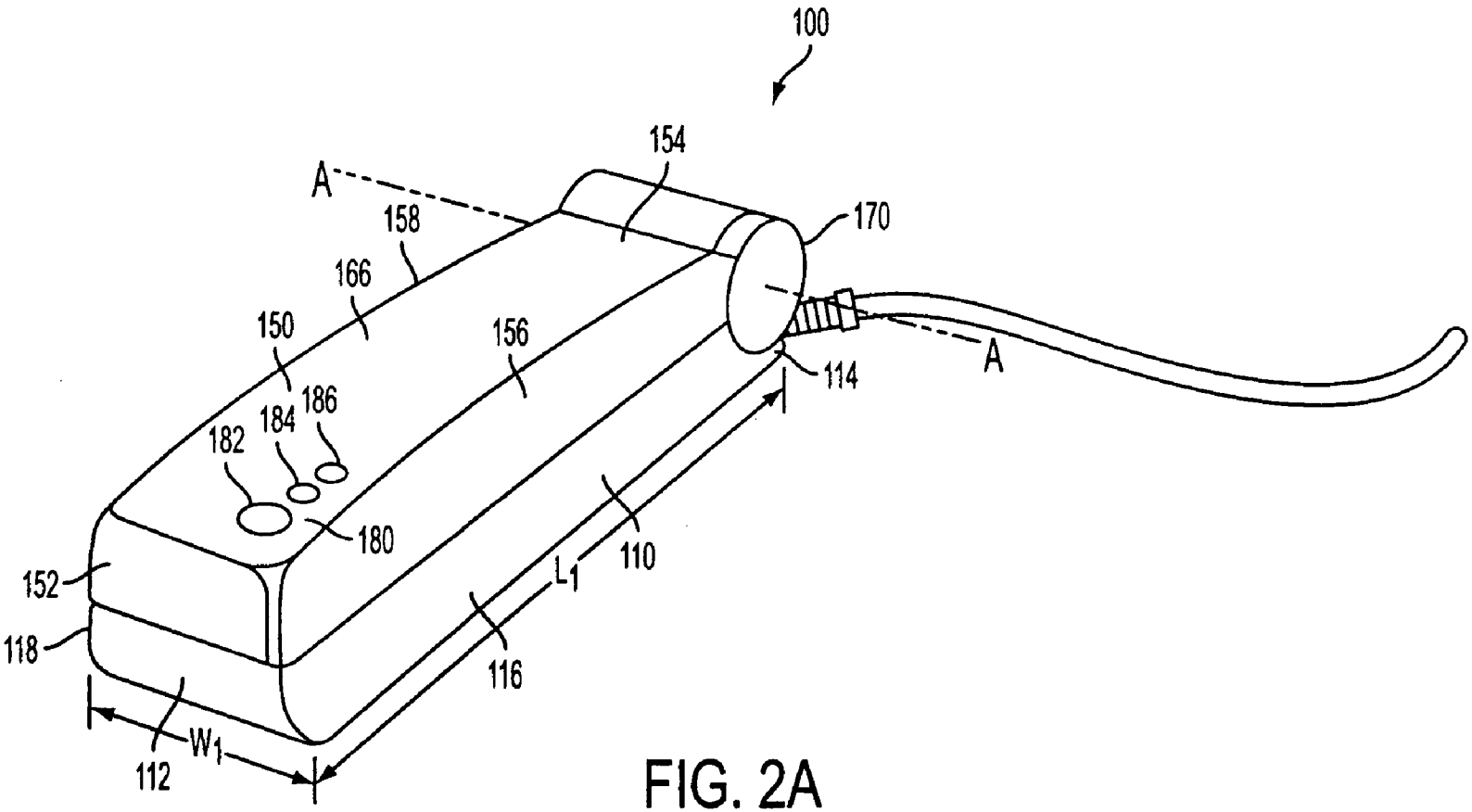
FIG. 2A is an isometric view that illustrates certain embodiments of a pivoting vacuum packaging appliance.
Figure 2B:
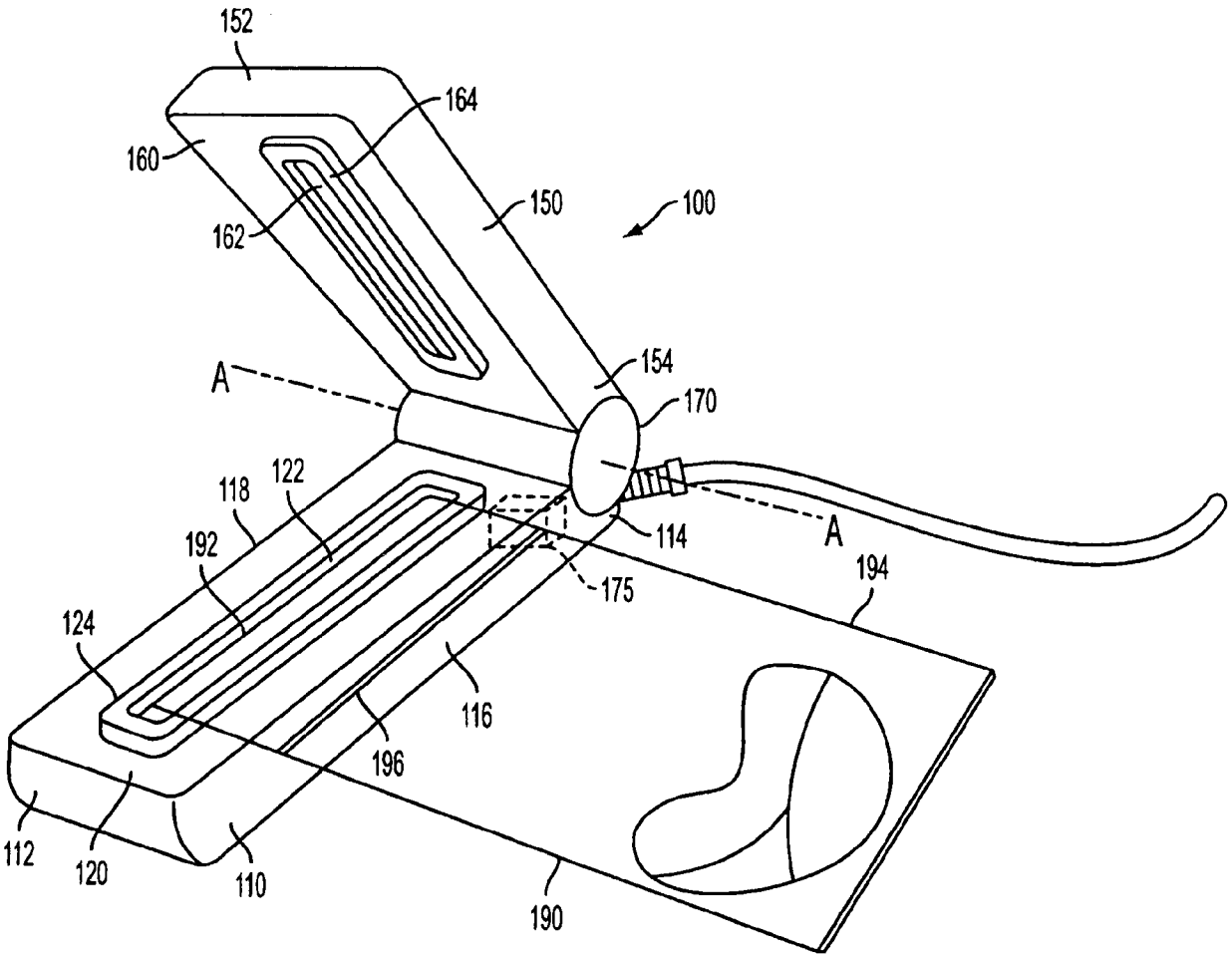
FIG. 2B is a side view of the pivoting vacuum packaging appliance of FIG. 2A.

FIGS. 2A and 2B are schematic isometric views of a vacuum packaging appliance 100 for use with a bag 190 in accordance with an embodiment of the invention. The vacuum packaging appliance 100 includes a base 110, a lid 150, and a hinge 170 pivotably coupling the lid 150 to the base 110. The lid 150 is pivotable about an axis A—A between a closed position (shown in FIG. 2A and an open position (shown in FIG. 2B). The illustrated base 110 includes a distal end 112, a proximal end 114 opposite the distal end 112, and a length $L_1$ between the distal end 112 and the proximal end 114. As such, the length $L_1$, or major dimension of the base 110, extends in a direction generally perpendicular to the axis A—A. The base 110 further includes a first side 116 between the distal and proximal ends 112 and 114, a second side 118 between the distal and proximal ends 112 and 114 and opposite the first side 116, and a width $W_1$ between the first side 116 and the second side 118. The width $W_1$ of the base 110 extends in a direction generally parallel to the axis A—A and is less than the length $L_1$ of the base 110. For example, the ratio of the length $L_1$ to the width $W_1$ of the base 110 can be 2:1, 3:1, 4:1, 5:1, or other suitable proportions.

The illustrated base 110 further includes an inner surface 120, a first chamber portion 122 extending in a direction generally perpendicular to the axis A—A, and a first seal 124 surrounding the first chamber portion 122. The first seal 124 can be attached to the inner surface 120, received in a groove in the surface 120, and/or otherwise positioned to at least partially define the first chamber portion 122. The inner surface 120 can also have a recess to at least partially define the first chamber portion 122. In several embodiments, the appliance 100 may further include a removable trough in the first chamber portion 122 for receiving or catching liquid from the bag 190.

Figure 2C:
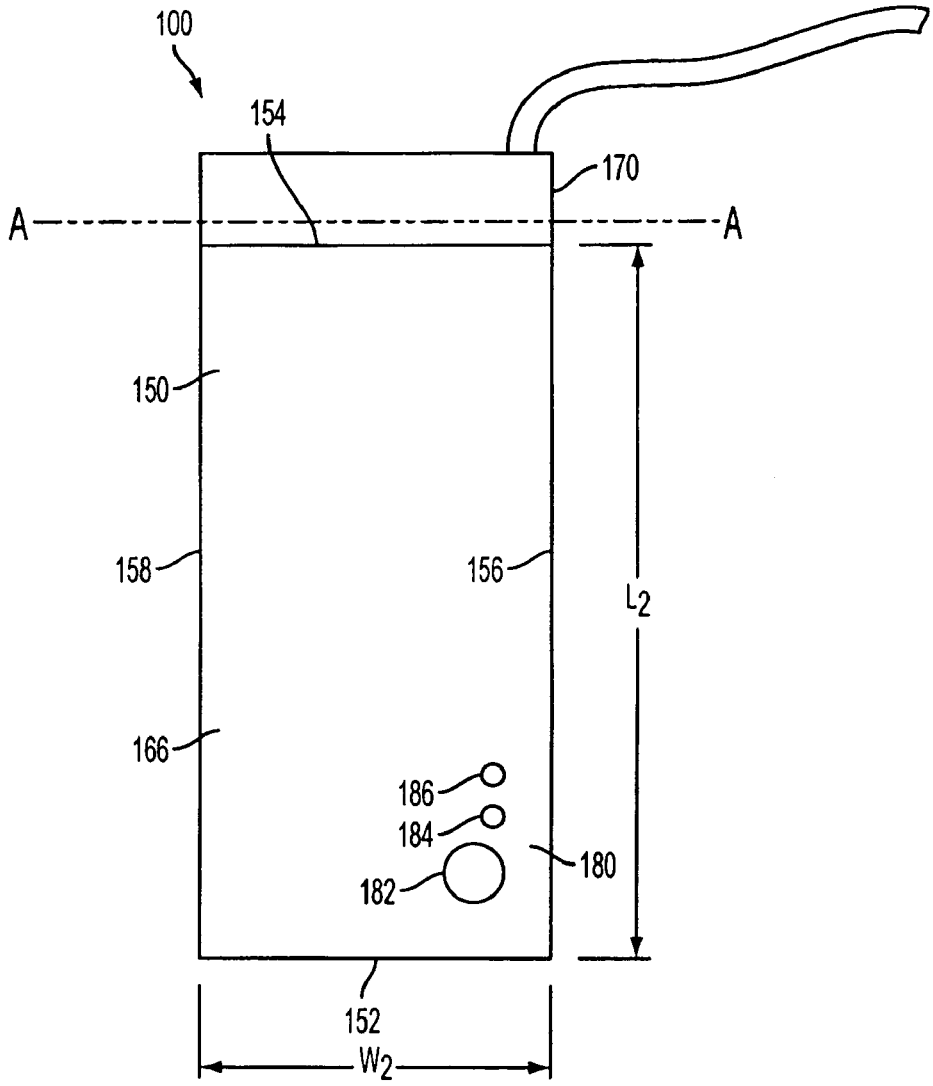
FIG. 2C is a top plan view of the pivoting vacuum packaging appliance of FIG. 2A.

FIG. 2C is a schematic top plan view of the appliance 100 of FIGS. 2A and 2B. The illustrated lid 150 includes a distal end 152, a proximal end 154 opposite the distal end 152, and a length $L_2$ between the distal end 152 and the proximal end 154. As such, the length $L_2$, or major dimension of the lid 150, extends in a direction generally perpendicular to the axis A—A. The lid 150 further includes a first side 156 between the distal and proximal ends 152 and 154, a second side 158 between the distal and proximal ends 152 and 154 and opposite the first side 156, and a width $W_2$ between the first side 156 and the second side 158. The width $W_2$ of the lid 150 extends in a direction generally parallel to the axis A—A and is less than the length $L_2$ of the lid 150.

Referring to FIG. 2B, the illustrated lid 150 further includes an inner surface 160, a second chamber portion 162 extending in a direction generally perpendicular to the axis A—A, and a second seal 164 surrounding the second chamber portion 162. The second seal 164 can be attached to the inner surface 160, received in a groove in the inner surface 160, and/or otherwise positioned to at least partially define the second chamber portion 162. The inner surface 160 can also include a recess to at least partially define the second chamber portion 162. When the lid 150 is in the closed position, the first and second chamber portions 122 and 162 are aligned and form a vacuum chamber. In other embodiments, the vacuum packaging appliance 100 can have other configurations. For example, the base 110 and/or the lid 150 may not include a chamber portion and/or a seal.

The vacuum packaging appliance 100 further includes a vacuum pump 175 (shown schematically in hidden lines in FIG. 2B) operably coupled to the first and/or second chamber portion 122 and/or 162 for removing gas from the vacuum chamber when the lid 150 is in the closed position. The vacuum pump 175 also removes gas from the interior of the bag 190 when an open end 192 of the bag 190 is positioned in the vacuum chamber and a body 194 of the bag 190 projects out from the appliance 100 in a direction generally parallel to the axis A—A. Conventional vacuum packaging bags, such as those described in U.S. Pat. No. Re. 34,929, which is hereby incorporated by reference in its entirety, are configured with a plurality of inner-communicating channels so that the interior of the bag 190 is in fluid communication with the vacuum chamber when the lid 150 is in the closed position. Accordingly, the vacuum pump 175 can remove gas from the vacuum chamber and the interior of the bag 190.

After gas is removed, the bag 190 is sealed to inhibit ambient air from flowing into the interior of the bag 190. The illustrated bag 190 includes a reusable zipper 196 for sealing the bag 190. Zipper bags are described in U.S. Provisional Patent Application No. 60/491,722, filed Jul. 31, 2003, which is hereby incorporated by reference. Bags that do not include a zipper can be thermally sealed as described below with reference to FIGS. 3 and 4.

Referring to FIGS. 2A and 2C, the illustrated lid 150 further includes an outer surface 166 and a control panel 180 on the outer surface 166 for manually controlling operation of the vacuum packing appliance 100. The control panel 180 can optionally include a vacuum button 182, an On/Off button 184, and an indicator light 186. In embodiments in which the vacuum operation automatically starts when the lid 150 is moved to the closed position, the vacuum button 182 can be used to extend the vacuum time to ensure the maximum volume of gas is removed from the bag 190. In other embodiments, the vacuum operation may not start automatically when the lid 150 moves to the closed position. In such embodiments, a user can depress the vacuum button 182 to remove gas from the bag.

The On/Off button 184 can be a fail-safe mechanism for ensuring that the vacuum pump 175 is not unintentionally activated. For example, in embodiments in which the vacuum operation automatically starts when the lid 150 is moved to the closed position, the On/Off button 184 can deactivate the vacuum pump 175 so that the pump 175 does not operate even when the lid 150 is in the closed position. The indicator light 196 can signal that the appliance 100 is on or the start or completion of various processes, such as the vacuum or sealing process. The control panel 180 may optionally include a cancel button (not shown) for canceling a given operation in progress. Moreover, in embodiments in which the vacuum packaging appliance includes a heating element, such as the embodiments described below with reference to FIGS. 3 and 4, the control panel 180 may also include an instant seal button for activating the heating element to seal a bag and/or a sealing time adjustment knob for controlling the heating element. If the heating element is automatically activated when the lid 150 moves to the closed position, the instant seal button may be used to seal the bag before a complete vacuum is created in the bag. This feature may be useful when vacuum packaging fragile items so that the items are not crushed.

One feature of the appliance 100 illustrated in FIGS. 2A–2C is that the distance between the first side 116 and the second side 118 of the base 110 is less than the distance between the distal end 112 and the proximal end 114. As such, the length $L_1$, or major dimension of the base 110, extends in a direction generally perpendicular to the axis A—A. Because the size of the hinge 170 is reduced, the footprint of the appliance 100 is smaller and, consequently, the appliance 100 requires less space on the countertop or other surface.

C. Additional Embodiments of Vacuum Packaging Appliances

Figure 3:
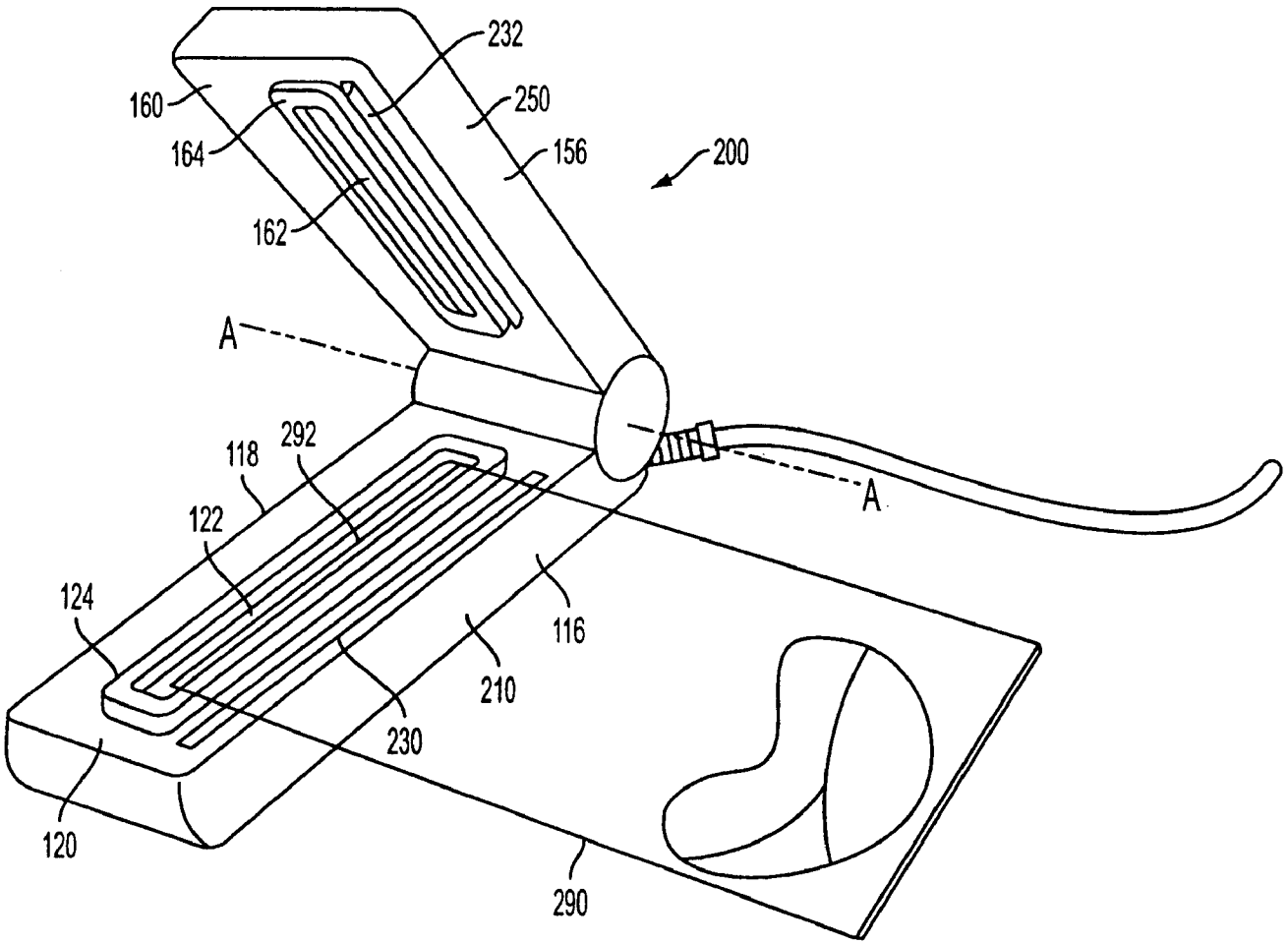
FIG. 3 is a schematic isometric view of a vacuum packaging appliance in accordance with another embodiment of the invention.

FIG. 3 is a schematic isometric view of a vacuum packaging appliance 200 in accordance with another embodiment of the invention. The illustrated appliance 200 is generally similar to the appliance 100 described above with reference to FIGS. 2A–2C. For example, the appliance 200 includes a base 210, a lid 250 pivotably coupled to the base 210, a first chamber portion 122 on the base 210, a first seal 124 surrounding the first chamber portion 122, a second chamber portion 162 on the lid 250, and a second seal 164 surrounding the second chamber portion 162. The illustrated appliance 200, however, further includes a heating element 230 for thermally sealing a bag 290 and a member 232 for pressing the bag 290 against the heating element 230. The heating element 230 can be carried by the inner surface 120 of the base 210, and the member 232 can be carried by and projected from the inner surface 160 of the lid 250. The illustrated heating element 230 is positioned between the first side 116 and the first chamber portion 122 so that the element 230 is offset a short distance from an open end 292 of the bag 290 when the open end 292 is received in the first chamber portion 122. The heating element 230 extends in a direction generally perpendicular to the axis A—A over a length sufficient to seal a strip of the bag 290. The member 232 is aligned with the heating element 230 so that the member 232 presses the bag 290 against the heating element 230 when the lid 250 is in the closed position.

The heating element 230 is configured to thermally seal the bag 290 after gas has been substantially evacuated from the interior of the bag 290. Conventional vacuum packaging bags, such as the bag 290 illustrated in FIG. 3, include panels with a gas impermeable layer and a heat sealable layer inside the gas impermeable layer. The heating element 230 heats the bag 290 sufficiently to bond the heat sealable layer of each panel together, and the member 232 presses the bag 290 against the heating element 230 to ensure that a seal is formed across a strip of the bag 290. An advantage of the illustrated appliance 200 is that the heating element 230 thermally seals bags. Accordingly, the appliance 200 can be used with bags that do not include a zipper or other means for sealing.

Figure 4:
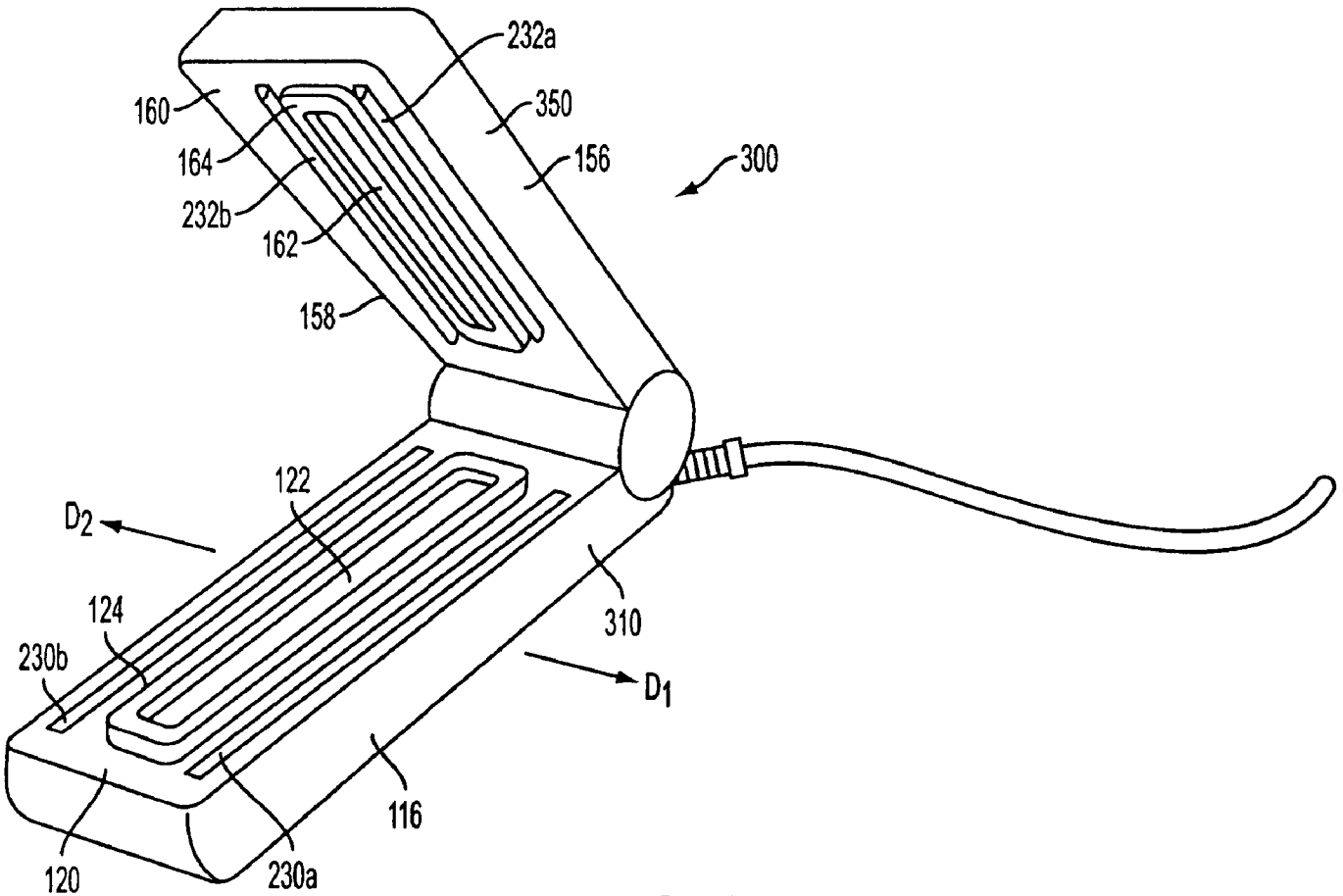
FIG. 4 is a schematic isometric view of a vacuum packaging appliance in accordance with another embodiment of the invention.

FIG. 4 is a schematic isometric view of a vacuum packaging appliance 300 in accordance with another embodiment of the invention. The illustrated appliance 300 is generally similar to the appliance 200 described above with reference to FIG. 3. The illustrated appliance 300, however, includes a base 310 with first and second heating elements 230*a–b* and a lid 350 with first and second members 232*a–b* for pressing a bag against one of the heating elements 230*a–b*. The first heating element 230*a* is positioned between the first side 116 and the first chamber portion 122, and the second heating element 230*b* is positioned between the second side 118 and the first chamber portion 122. The first member 232*a* is positioned between the first side 156 and the second chamber portion 162, and the second member 232*b* is positioned between the second side 158 and the second chamber portion 162. The first member 232*a* is aligned with the first heating element 230*a* and the second member 232*b* is aligned with the second heating element 230*b* so that one of the members 232*a–b* can press a bag against one of the heating elements 230*a–b*.

One feature of the appliance 300 illustrated in FIG. 4 is that the first and second heating elements 230*a–b* allow a user to place a bag in the appliance 300 in either one of two positions. More specifically, the user can place the bag in the appliance 300 such that the body of the bag projects in a direction D, from the appliance 300, or the body of the bag projects in a direction $D_2$ from the appliance 300. The appliance 300 can evacuate and thermally seal the bag in either position. An advantage of this feature is that the user has the flexibility to position bags in the most convenient side of the appliance 300.

Figure 5A:
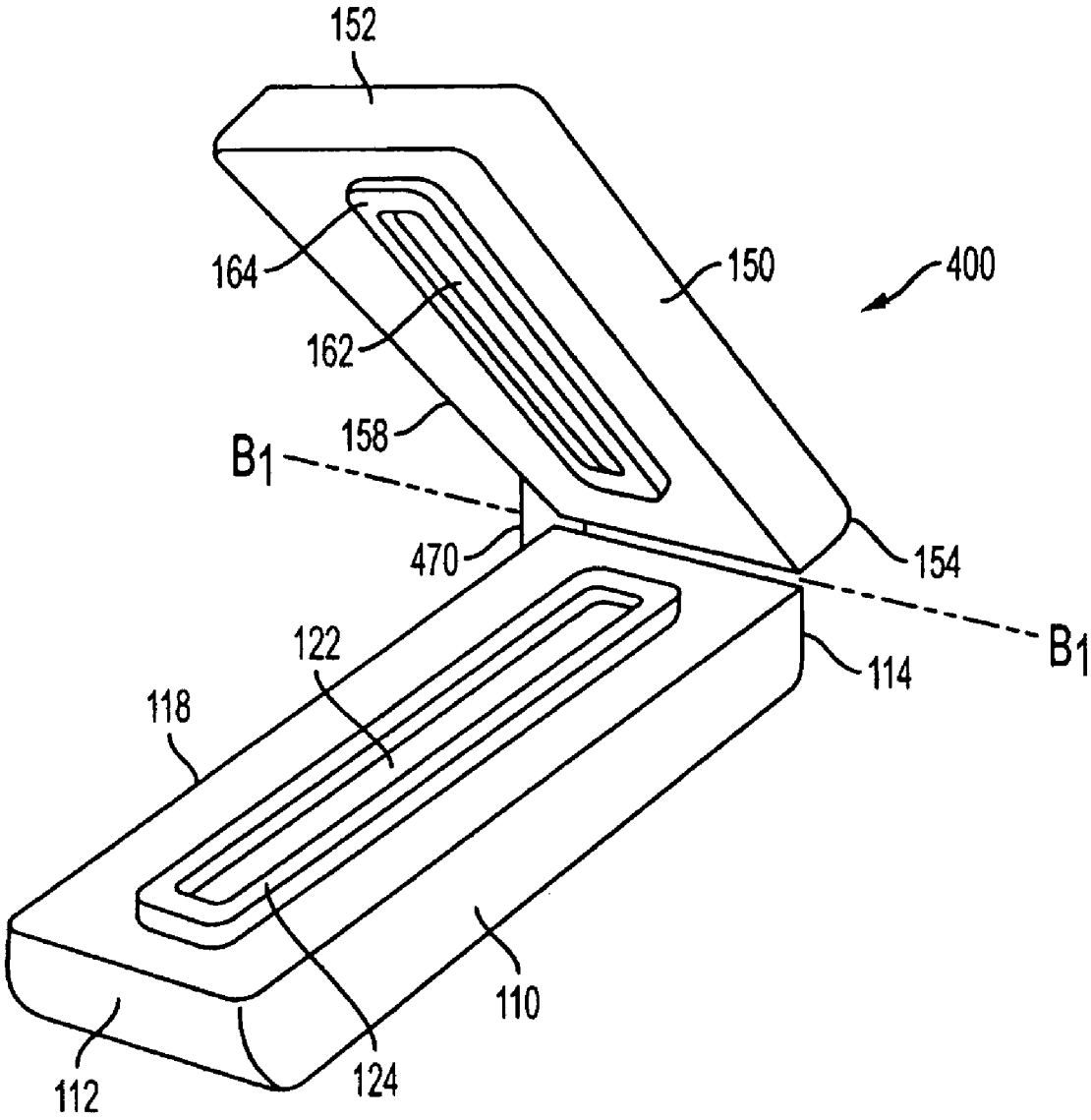
FIG. 5A is a schematic isometric view of a vacuum packaging appliance in accordance with another embodiment of the invention.
Figure 5B:
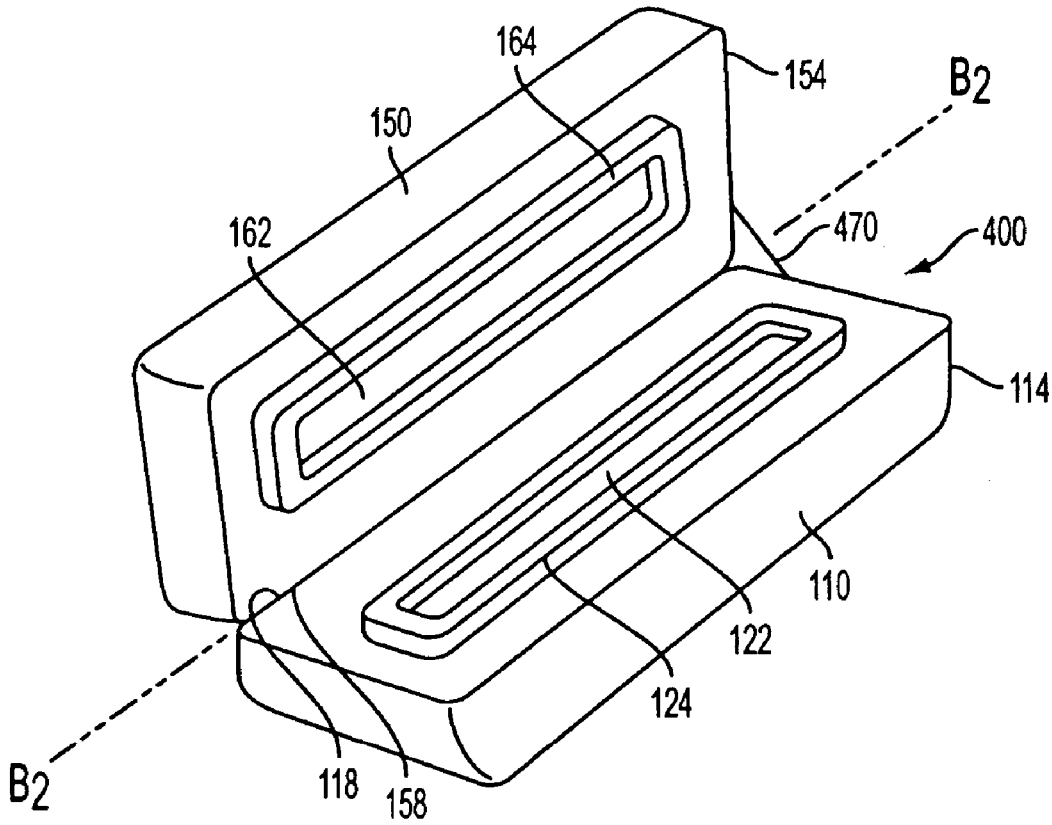
FIG. 5B is a schematic isometric view of the vacuum packaging appliance of FIG. 5A with a lid in the open position.

FIGS. 5A and 5B are schematic isometric views of a vacuum packaging appliance 400 in accordance with another embodiment of the invention. The illustrated appliance 400 is generally similar to the appliance 100 described above with reference to FIGS. 2A–2C. For example, the illustrated appliance 400 includes a base 110 and a lid 150 movably coupled to the base 110. The illustrated appliance 400, however, includes a biaxial hinge 470 coupled to the proximal end 114 and second side 118 of the base 110 and the proximal end 154 and second side 158 of the lid 150. The biaxial hinge 470 allows the lid 150 to pivot about a first axis $B_1$—$B_1$ (FIG. 5A) and a second axis $B_2$—$B_2$ (FIG. 5B) generally perpendicular to the first axis $B_1$—$B_1$. As such, the appliance 400 can pivot between an open position (illustrated in FIG. 5A) and a closed position (not shown) about the first axis $B_1$—$B_1$, and pivot between an open position (FIG. 5B) and a closed position (not shown) about the second axis $B_2$—$B_2$. One advantage of the illustrated appliance 400 is that the user can pivot the lid 150 about the first axis $B_1$—$B_1$ or the second axis $B_2$—$B_2$ depending upon whichever configuration of the appliance 400 is more convenient.

From the foregoing, it will be appreciated that specific embodiments of the invention have been described herein for purposes of illustration, but that various modifications may be made without deviating from the spirit and scope of the invention. For example, the vacuum packaging appliances can have any combination of the features described above with reference to FIGS. 2A–5B. Accordingly, the invention is not limited except as by the appended claims.

We claim:

1. A vacuum packaging appliance for use with a bag, the appliance comprising:

a housing having a width from a left edge to a right edge and a length from a front edge to a back edge, the housing including;

a base;

a cover pivotally coupled to the base;

wherein the cover and the base are adapted to receive an open end of the bag there between when the cover is pivoted relative to the base to an open position and adapted to cooperatively capture the open end of the bag when the cover is pivoted relative to the base to a closed position;

wherein the ratio of the width to the length is at least 1:4;

further comprising a vacuum chamber portion on the base and/or the lid for receiving directly an open end of the bag;

further comprising a vacuum pump operably coupled to the vacuum chamber portion for removing gas from the vacuum chamber portion;

wherein the vacuum chamber portion is on the base, and wherein:

the appliance further comprises first and second heating elements carried by the base and arranged so that the vacuum chamber portion is positioned between the first and second heating elements.

2. The appliance of claim 1, wherein:

the vacuum pump is contained within the base.

* * * * *